United States Patent [19]

Proctor

[11] 4,007,927

[45] Feb. 15, 1977

[54] INERTIAL CYCLE EXERCISER

[76] Inventor: Richard I. Proctor, 3201 Orange Grove Ave., North Highlands, Calif. 95660

[22] Filed: Oct. 28, 1975

[21] Appl. No.: 626,485

[52] U.S. Cl. ..... 272/73; 128/25 R; 272/132

[51] Int. Cl.[2] ..... A63B 21/00

[58] Field of Search ..... 272/73, 132; 128/25

[56] References Cited

UNITED STATES PATENTS

| | | | |
|---|---|---|---|
| 1,336,774 | 4/1920 | Cooper | 272/73 |
| 2,668,709 | 2/1954 | Boyko | 272/73 |
| 3,572,699 | 3/1971 | Nies | 272/73 |

FOREIGN PATENTS OR APPLICATIONS

| | | | |
|---|---|---|---|
| 1,961,488 | 7/1970 | Germany | 272/73 |

*Primary Examiner*—Richard C. Pinkham
*Assistant Examiner*—T. Brown
*Attorney, Agent, or Firm*—Lothrop & West

[57] ABSTRACT

A stationary frame on a supporting surface carries a handlebar and seat to accommodate a person wishing to exercise. A flywheel above the supporting surface is journaled on the frame for rotation by a pair of pedals; and an adjustment knob on the frame enables the rider to control the amount of braking resistance exerted on the flywheel by a pair of brake shoes.

2 Claims, 4 Drawing Figures

23
24
24
23
31
32
33
26
11
42
2
2
53
43
79
29
13
13
28
28
16
12
22
46
40
38
85
27
17
19
22
37
19
13
21
18
84
83
36
39
41
14
21
15
18

INERTIAL CYCLE EXERCISER

BACKGROUND OF THE INVENTION

The market place as well as the patent literature are not without examples of exercising machines of the inertial, or flywheel, type. Inclusive of such machines are the disclosures in the following U.S. Pat. Nos.: E. N. Bowen, 334,635 dated Jan. 19, 1886; J. B. Weitzel, 3,100,640 dated Aug. 13, 1963; T. T. Gibbs, 3,485,495 dated Dec. 23, 1969; and, Paolo DiNepi, 3,578,800, dated May 18, 1971.

Despite the numerous kinds of inertial cycle exercisers disclosed by the foregoing patents, however, there is still considerable room for improvement, particularly in the direction of economy, reliability, and smoothness and quietness of operation.

SUMMARY OF THE INVENTION

The invention relates to exercising machines of the inertial cycle type and, more particularly, to machines of this variety which enable the user to regulate the extent of frictional resistance imposed against the flywheel and thus the amount of tension opposing the muscular effort exerted by the user.

It is an object of the invention to provide an inertial cycle exerciser which is compact in size and streamlined in configuration so that it takes up but little floor space and is easy to get on and off.

It is another object of the invention to provide an inertial cycle exerciser which is devoid of accoutrements such as chains, sprockets, chain guards, cables, linkages, gear transmissions, and the like, which increase initial cost as well as upkeep expense.

It is a further object of the invention to provide an inertial cycle exerciser in which the flywheel is directly driven by the pedals, yet which avoids the usual "dead spots" in the pedal revolution by reason of the "carry-over" afforded by the inertia of the wheel.

It is yet a further object of the invention to provide an inertial cycle exerciser in which the tension adjustment is conveniently located and gives the rider a nice degree of control.

It is still another object of the invention to provide an inertial cycle exerciser which is smooth and quiet in operation.

It is an additional object of the invention to provide a generally improved inertial cycle exerciser.

Other objects, together with the foregoing, are attained in the embodiment described in the following description and illustrated in the accompanying drawings.

SHORT DESCRIPTION OF DRAWINGS

DETAILED DESCRIPTION OF PREFERRED EMBODIMENT

Figure 1:
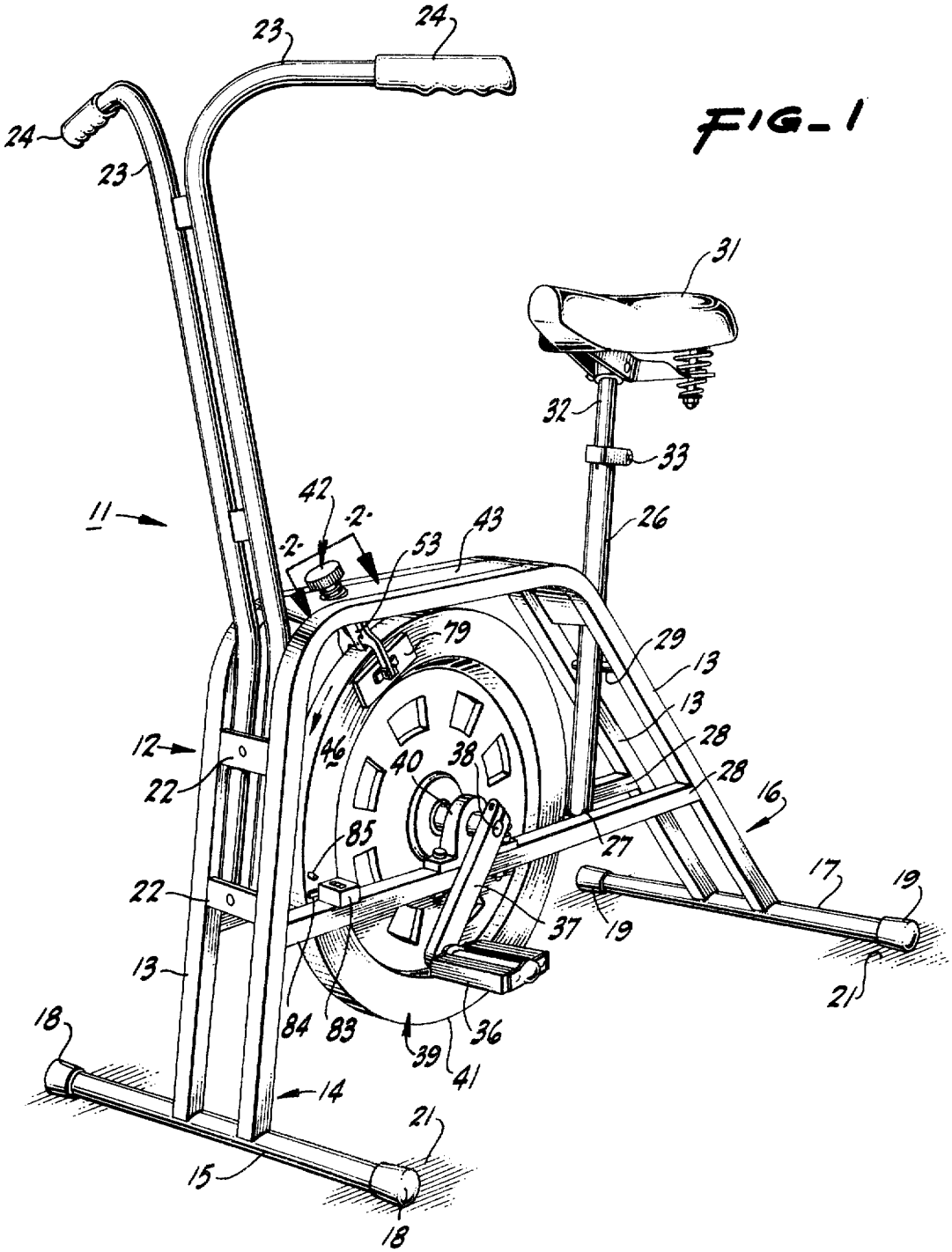
FIG. 1 is a front left perspective view.

While the inertial cycle exerciser of the invention is susceptible of numerous physical embodiments, depending upon the environment and requirements of use, substantial numbers of the herein shown and described embodiments have been made, tested and used, and all have performed in an eminently satisfactory manner.

The inertial cycle exerciser of the invention, generally designated by the reference numeral 11, includes a fore and aft, elongated, arched frame 12 including a laterally spaced pair of square in section tubes 13 supported at the front end 14 on a transverse front tube 15 and at the rear end 16 on a transverse rear tube 17.

The transverse front and rear tubes 15 and 16 are provided with pairs of crutch tips 18 and 19, respectively, to cushion the exerciser on a supporting surface 21, such as a floor.

Mounted on a vertical spaced pair of braces 22 spanning the forward frame tubes 13 is a pair of handlebars 23 with handles 24. In similar manner, a substantially vertical seat post 26 is mounted adjacent the after end 16 of the exerciser, the bottom of the post 26 being supported by a cross bar 27 spanning a spaced pair of horizontal, fore and aft beams 28 of square in section tubing forming a part of the frame 12. Where the seat post 26 intercepts the after portion of the frame, a cross bar 29 spanning the frame tubes 13 provides additional support, the seat post being secured to the cross bar 29 as by welding.

A seat 31 is mounted on the upper end of a tube 32 in adjustable telescoping relation with respect to the seat post 26, the seat being held at the desired height by a clamp 33.

The seat 31 is adjusted so that when the rider is seated thereon, the bottom of the rider's feet engage the surface of a pair of drive pedals 36. The pedals are pivotally mounted on respective crank arms 37 connected to the axle 38 of a flywheel 39. The flywheel axle 38, in turn, is journaled in a pair of bearings 40 supported on the fore and aft beams 28.

The flywheel 39, which is located in a median, vertical, fore and aft plane, has the weight concentrated on the outer rim 41 at a radial distance greater than the distance from the axle 38 to the pedal pivot axis, thereby affording smooth operation even though two "dead spots" occur during each revolution of a pedal, once when the user's leg is extended the maximum and once when the leg is farthest retracted. The inertia possessed by the wheel carries it past the "dead spots" without any noticeable change in velocity even though a substantial amount of external resistance is imposed on the wheel. The gyroscopic effect of the flywheel also lends stability to the device.

In the interests of smoothness and quietness of operation, the flywheel is carefully balanced, both statically and dynamically, and is accurately positioned in the bearings so that internal friction is minimized.

Since the fundamental purpose of the machine, however, is to provide dynamic tension, i.e. opposition to muscular effort during muscle flexure, external resistance is applied to the wheel. Furthermore, in order to accommodate users of varying capabilities and to provide progressively increasing tension for persons so desiring, the tensioning mechanism is made adjustable.

Figure 2:
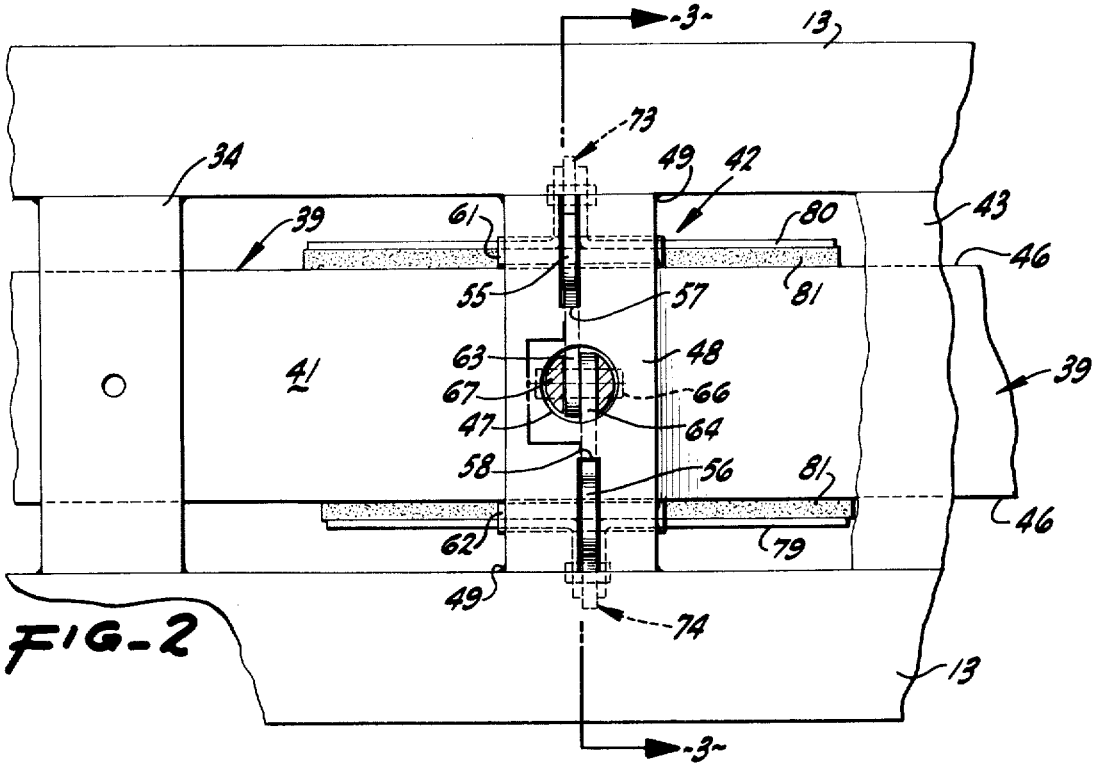
FIG. 2 is a fragmentary top view on the line 2 — 2, to an enlarged scale, of the tension adjusting mechanism, the platform plate, knob, stem and spring having been removed to reveal underlying details.

The tensioning mechanism, generally designated by the reference numeral 42 is mounted on the frame 12, and, more particularly, on and below a fore and aft, horizontal platform plate 43 located on the top central portion of the frame arch where the arch is substantially planar and horizontal. The plate 43 is mounted on a pair of transverse support members 34, the forward one of which appears in FIG. 2.

Protruding upwardly through an opening 35 in the platform plate 43, and at a slight forward angle, is a stem 44 surmounted by a knurled knob 45 located within easy reach of a rider.

The upper end of the stem 44 is threaded and engages a tapped axial opening in the knob 45.

In some installations, a set screw 6 is used to secure the knob to the stem at any desired axial position on the stem. By loosening the set screw 6 temporarily, relocating the knob 45 axially on the stem by rotating the knob in a suitable direction and tightening the set screw 6, more or less frictional resistance is exerted against the flywheel 39.

In many instances, however, the set screw 6 is not utilized, the threaded fit being tight enough to prevent vibrational displacement of the knob.

Figure 3:
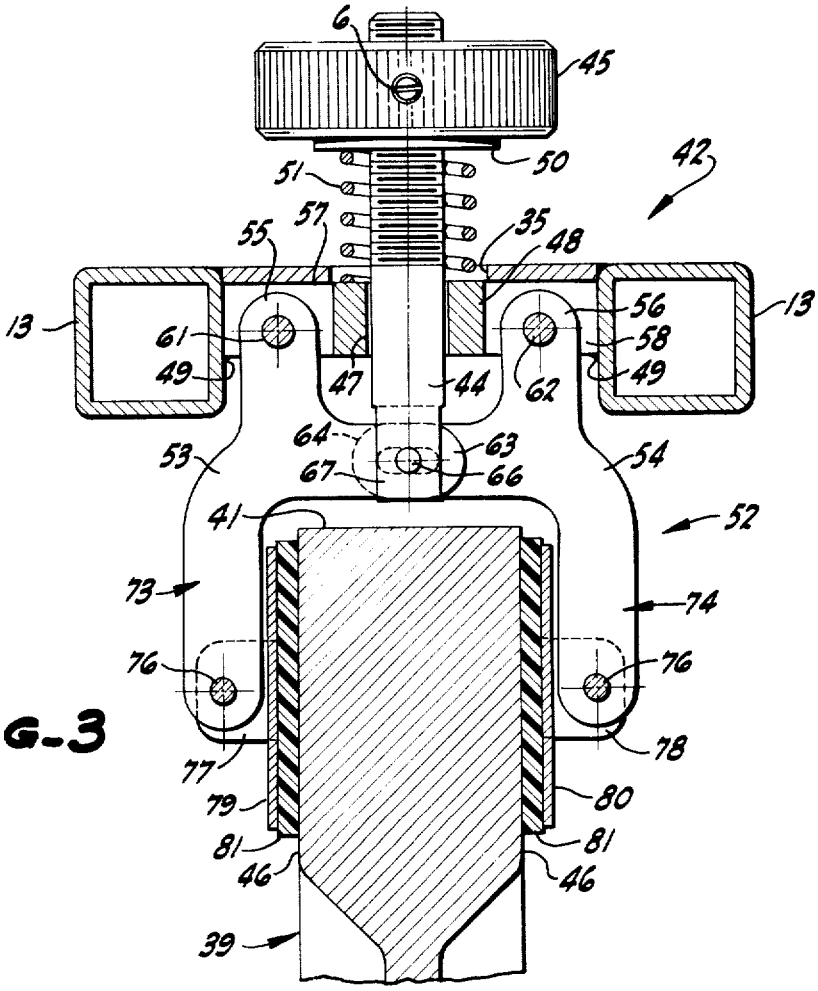
FIG. 3 is a fragmentary, transverse, sectional view, to an enlarged scale, the compound planes of the section being indicated by the line 3 — 3 in FIG 2; and, FIG. 4 is a fragmentary, median, vertical, fore and aft, sectional view, to an enlarged scale, of the tension adjusting device.
Figure 4:
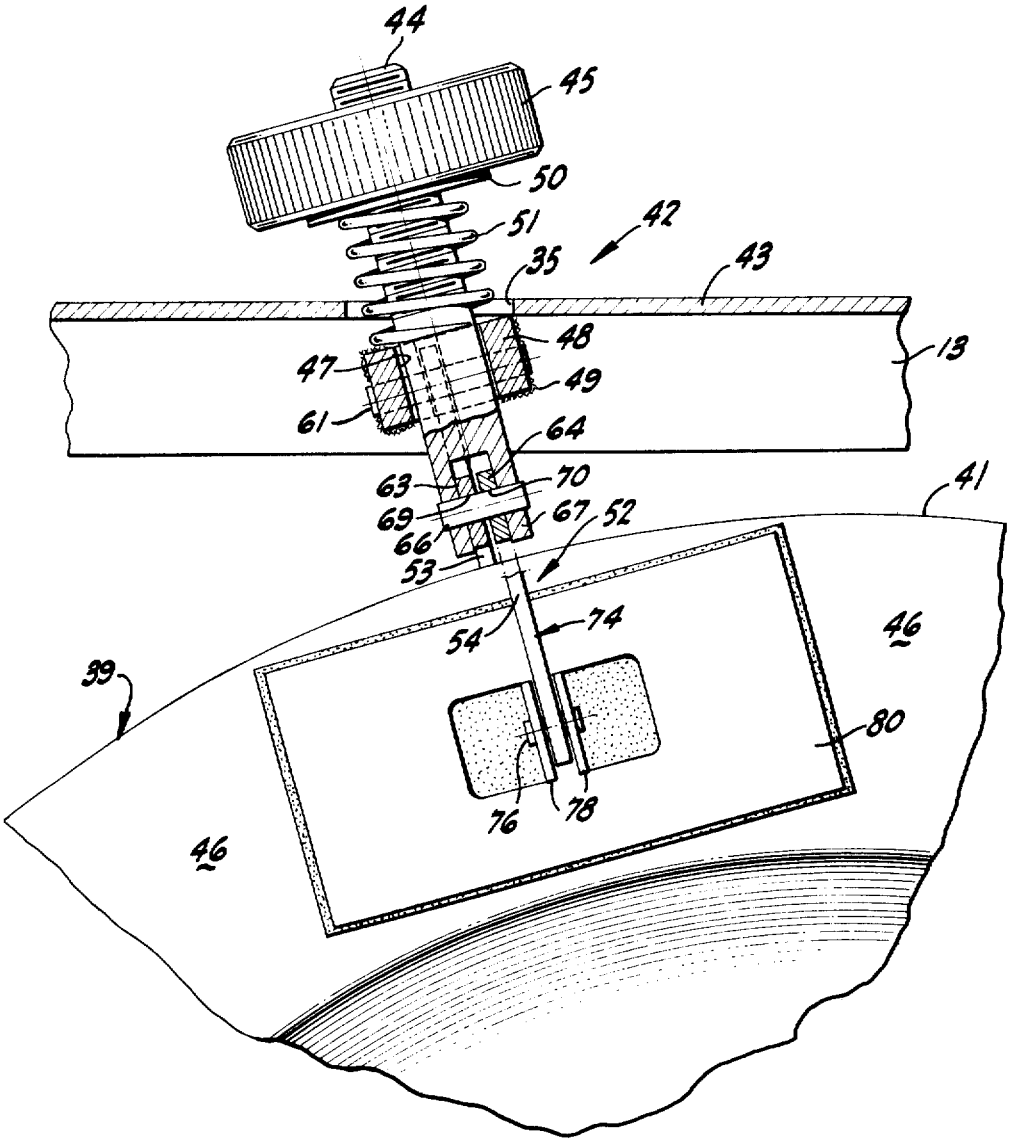

As can be seen most clearly in FIGS. 3 and 4, the stem 44 is translatably mounted in a bore 47 formed in a transverse block 48 spanning the frame tubing 13 in the top, horizontal portion of the frame arch, the block 48 being secured by weldments 49, for example.

Urging the stem 44 and knob 45 upwardly is a strong compression spring 51 interposed between the block 48 and an annular boss 50 on the lower surface of the knob.

Opposing the upward urgency of the spring 51 is a caliper brake system 52 including an opposed pair of pivotally mounted caliper arms 53 and 54.

The respective upper ends 55 and 56 of the caliper arms 53 and 54 (see FIGS. 2 and 3) are disposed in two transversely oriented and offset slots 57 and 58 in the block 48, and are pivotally mounted on respective pins 61 and 62 extending in a fore and aft (and slightly inclined) direction through the block 48 (see FIG. 4).

The caliper arms 53 and 54 are correspondingly offset in a fore and aft direction, with the arm 53 located on a plane removed somewhat forward of the plane of the arm 54. Thus, the two transverse lever arms 63 and 64 respectively, projecting toward each other from the respective caliper arms 53 and 44 are in overlapping relation and are concurrently acted upon by a fore and aft clevis pin 66 carried on the bifurcated lower end 67 of the stem 44. The clevis pin 66 extends through respective laterally enlarged and registering openings 69 and 70 in the transverse arms 63 and 64 and exerts an upward urgency on the transverse arms 63 and 64 owing to the upward force imparted by the compression spring 51 on the knob 45.

A respective pair of brake levers 73 and 74 depend on each side of the flywheel rim and are pivotally connected by pins 76 to respective mounting brackets 77 and 78 outstanding from brake shoes 79 and 80. Brake lining material 81 engages the smooth side walls 46 of the flywheel rim.

When a rider mounts the cycle exerciser and engages the pedals 36, the static friction between the brake lining 81 and the side walls 46 requires some additional initial effort to get the flywheel in motion. As the wheel velocity reaches the desired amount the dynamic frictional resistance of the braking system provides a predetermined amount of tension to the user's legs and trunk.

This amount can readily be increased or decreased by rotating the knob 45 in the appropriate direction.

A revolution counter 83 is mounted on the forward end of one of the beams 28 and includes a feeler 84 which senses a single discontinuity, such as a small projection 85 on the adjacent rim side wall 46. The counter provides the user with information which is useful for comparison purposes in complying, for example, with a programmed course of instruction or training. The projection 85 is located at the outermost portion of the side wall 86 so that it does not interfere with the brake shoe 79.

When the exerciser is to be used in a closely supervised program, for therapeutic purposes, for example, the tension setting can be established at any desired value and maintained by use of the set screw 6 in the knob 45, as previously indicated. Thereafter, should the instructor wish to change the setting, it is merely necessary to loosen the screw, change to the amount of tension and re-set the screw.

It can therefore be seen that I have provided an inertial cycle exerciser which is smooth, reliable, quiet and substantially maintenance free, yet is versatile in that the tension can readily be adjusted to conform to requirements.

What is claimed is:

1. Inertial cycle exerciser comprising:

a. a stationary fore and aft frame on a supporting surface;

b. a handlebar mounted on the forward portion of said frame;

c. a seat mounted on the after portion of said frame;

d. a flywheel;

e. means for mounting said flywheel on the central portion of said frame for rotation of said flywheel above the supporting surface and in a median, vertical, fore and aft plane;

f. a pair of drive pedals connected to said flywheel;

g. a pair of pins mounted on said frame, said pins being symmetrically disposed on opposite sides of said flywheel and extending in a fore and aft direction;

h. a pair of caliper arms each including a substantially vertical brake lever and a substantially horizontal lever arm, each of said caliper arms being pivotally mounted on a respective one of said pins for movement in a transverse plane;

i. a pair of brake shoes each mounted on a respective one of said brake levers, said lever arms extending toward each other in overlapping relation and being formed with transverse overlapping slots respectively;

j. a substantially vertical stem translatably mounted on said frame;

k. a clevis pin connected to the lower end of said stem and slidably engaging in said slots, said stem extending through an opening in said frame;

l. a knob threaded onto the upper end of said stem for selective movement toward and away from said frame; and, m. a compression spring disposed between said frame and said knob, said spring being effective to urge said stem and said clevis pin substantially upwardly and thereby pivot said caliper arms so as to urge said brake shoes into frictional engagement with said flywheel, the extent of frictional force exerted by said brake shoes being dependent upon the position of said knob relative to said frame.

2. An inertial cycle exerciser as in claim 1 further comprising: a projection connected to said flywheel and a revolution counter connected to said frame, said projection engaging with a feeler of said revolution counter once per revolution of said flywheel to advance said revolution counter.

* * * * *